US007303520B2

(12) United States Patent
Biondi et al.

(10) Patent No.: US 7,303,520 B2
(45) Date of Patent: Dec. 4, 2007

(54) METHOD AND UNIT FOR FOLDING COUPONS ON A PACKING MACHINE

(75) Inventors: Andrea Biondi, Bologna (IT); Fausto Negrini, Castelfranco Emilia (IT)

(73) Assignee: G. D Societa' per Azioni, Battindarno (IT)

( * ) Notice: Subject to any disclaimer, the term of this patent is extended or adjusted under 35 U.S.C. 154(b) by 176 days.

(21) Appl. No.: 11/158,224

(22) Filed: Jun. 21, 2005

(65) Prior Publication Data

US 2005/0288162 A1 Dec. 29, 2005

(30) Foreign Application Priority Data

Jun. 25, 2004 (IT) ..... B2004A0405

(51) Int. Cl.
*B31F 1/08* (2006.01)

(52) U.S. Cl. ..... 493/420; 493/421; 53/136.1

(58) Field of Classification Search ..... 493/420, 493/421; 53/415, 135.1, 136.1
See application file for complete search history.

(56) References Cited

U.S. PATENT DOCUMENTS 3,975,009 A * 8/1976 Brown ..... 493/14
4,125,254 A * 11/1978 Boyer ..... 493/8
4,701,233 A * 10/1987 Beck et al. ..... 156/217
5,037,364 A * 8/1991 Whittenberger ..... 493/14
5,242,364 A 9/1993 Lehmann
5,674,334 A * 10/1997 Instance ..... 156/64
5,683,338 A 11/1997 Krasuski et al.
6,475,129 B1 * 11/2002 Lehmann ..... 493/421
6,606,944 B1 8/2003 Athans et al.
6,641,514 B1 11/2003 Hechler
6,743,161 B2 * 6/2004 Dannemann et al. ..... 493/442
7,174,938 B2 * 2/2007 Cadieux et al. ..... 156/461
7,175,586 B2 * 2/2007 Mattila et al. ..... 493/434
2003/0109367 A1 6/2003 Dannenmann et al.
2004/0000125 A1 * 1/2004 Cadieux et al. ..... 53/415

FOREIGN PATENT DOCUMENTS

EP 1 464 583 10/2004
WO 2004/003726 1/2004

* cited by examiner

*Primary Examiner*—Hemant M. Desai
(74) *Attorney, Agent, or Firm*—Ladas & Parry LLP

(57) ABSTRACT

A method and unit for folding coupons on a packing machine, whereby the coupons are fed to at least one folding station having two counter-rotating folding rollers, and at least one locating member located at one end of a feed path of the coupons extending over the two folding rollers; the operating speed of the folding station is determined cyclically, and, as a function of the operating speed of the folding station, the position of the locating member along the feed path of the coupons is adjusted during normal operation of the folding station.

27 Claims, 4 Drawing Sheets

METHOD AND UNIT FOR FOLDING COUPONS ON A PACKING MACHINE

The present invention relates to a method and unit for folding coupons on a packing machine.

The present invention may be used to particular advantage on a cigarette packing machine, to which the following description refers purely by way of example.

BACKGROUND OF THE INVENTION

It is fairly common practice to combine a packet of cigarettes with a coupon, which is normally enclosed inside the packet with the group of cigarettes. The coupon may be either the same size as or larger than the packet of cigarettes; in which latter case, it is folded for insertion inside the packet.

A known packing machine for producing packets of cigarettes with folded coupons comprises a conveyor for feeding a number of seats, each containing a respective group of cigarettes, along a packing path. The packing path extends through a feed station where a wheel, comprising a number of gripping heads, extracts the folded coupons one at a time from the bottom of a stack housed inside a store, and feeds each folded coupon to a respective seat on a packing conveyor, together with the corresponding group of cigarettes.

Various tests show known packing machines of the type described above to function satisfactorily at relatively low speed (up to 4-5 packets of cigarettes a second) but poorly at high speed (over 7-8 packets of cigarettes a second) on account of the fairly long time required to remove a folded coupon correctly from the bottom of a stack of folded coupons.

Packing machines have therefore been proposed, in which, at the coupon feed station, a flat strip of preprinted coupons is unwound off a reel and cut into individual coupons by a cutting device; each coupon is fed to a folding unit by which it is folded; and a transfer device receives each folded coupon from the folding unit, and feeds the folded coupon to a respective seat on a packing conveyor, together with the corresponding group of cigarettes.

One example of a cigarette packing machine with an on-line coupon-folding feature is described in Patent Application WO-2004003726-A1. More specifically, the packing machine comprises a roller folding unit or so-called "buckle folder" in turn comprising a succession of folding stations, each for making one fold in the coupons, and each having two counter-rotating rollers and a locating member. In actual use, a coupon is received from a folding station so as to rest on the two counter-rotating rollers, with one end of the coupon resting against the locating member. At this point, an intermediate portion of the coupon is gradually engaged by the counter-rotating rollers, so that the coupon is fed between the counter-rotating rollers and so folded.

Another example of a "buckle folder" roller folding unit is described in Patent Application EP-0522408-A1.

"Buckle folder" roller folding units have numerous advantages: they are compact, cheap and easy to produce, and can operate at high speed. On the other hand, good-quality folding tends to be restricted to a small range of operating speeds. That is, a "buckle folder" roller folding unit only operates well at substantially constant operating speed; which limitation poses serious problems on a cigarette packing machine, which is subject to numerous changes in speed to adapt to the operating conditions of the automatic (cigarette manufacturing, cellophaning, and cartoning) machines to which it is connected, as well as for cleaning, adjustment, maintenance and format changes.

SUMMARY OF THE INVENTION

It is an object of the present invention to provide a method and unit for folding coupons on a packing machine, designed to eliminate the aforementioned drawbacks, and which, in particular, are cheap and easy to implement.

According to the present invention, there are provided a method and unit for folding coupons on a packing machine, as claimed in the accompanying Claims.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
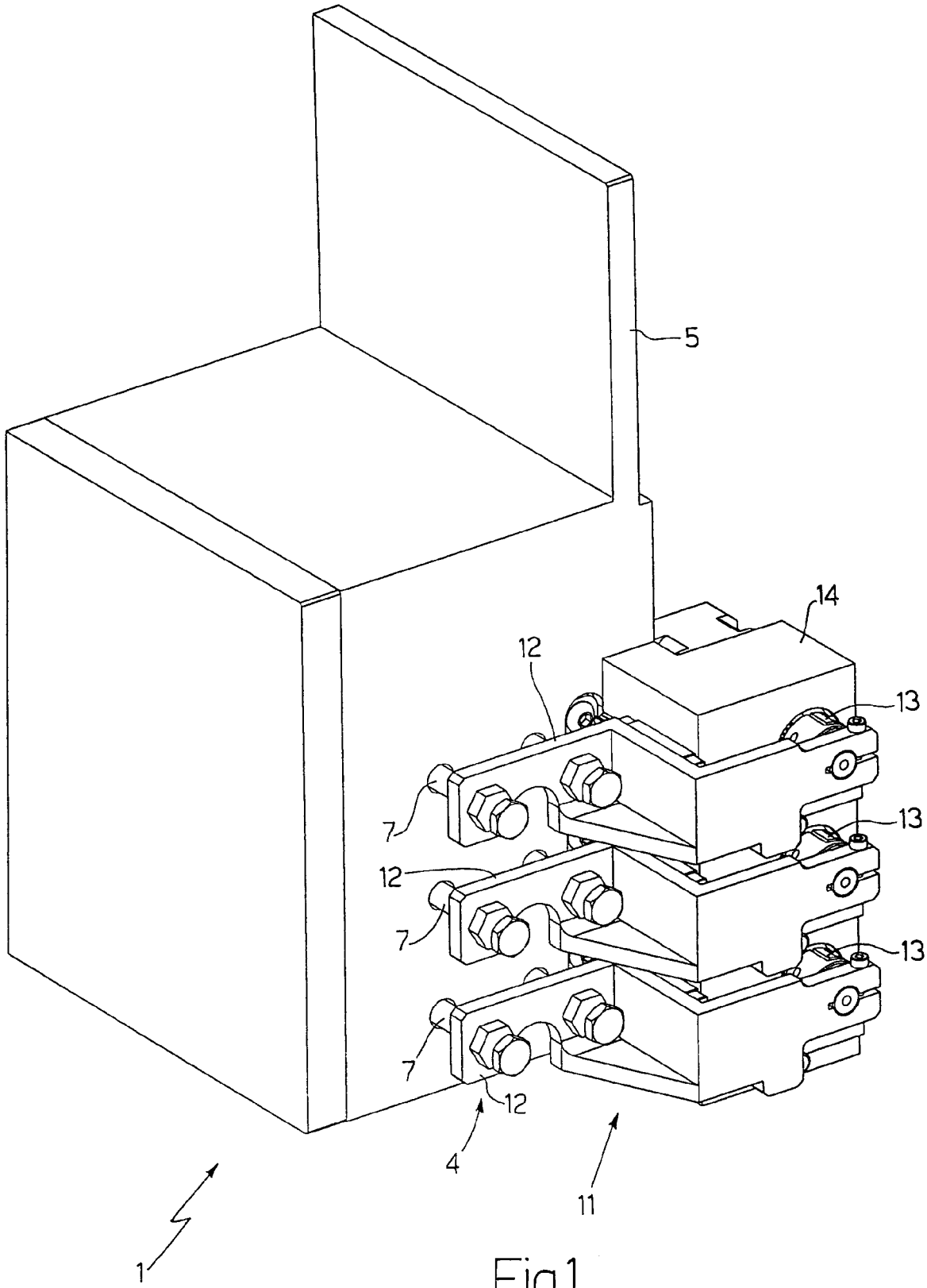
FIG. 1 shows a schematic view in perspective of a coupon-folding unit in accordance with the present invention.
Figure 4:
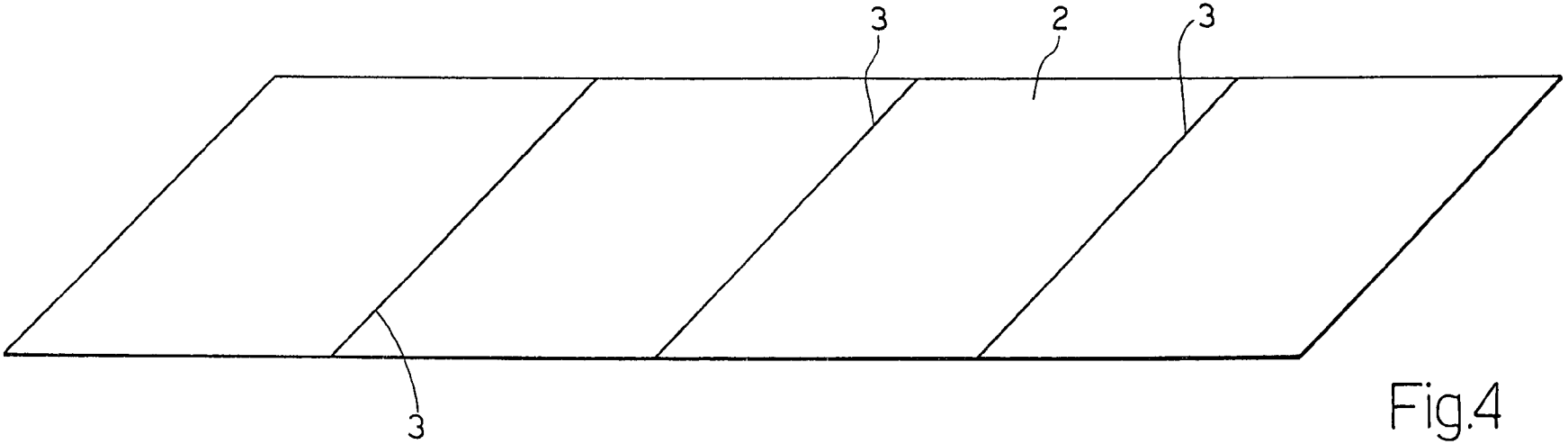
FIG. 4 shows a view in perspective of a flat coupon.
Figure 5:
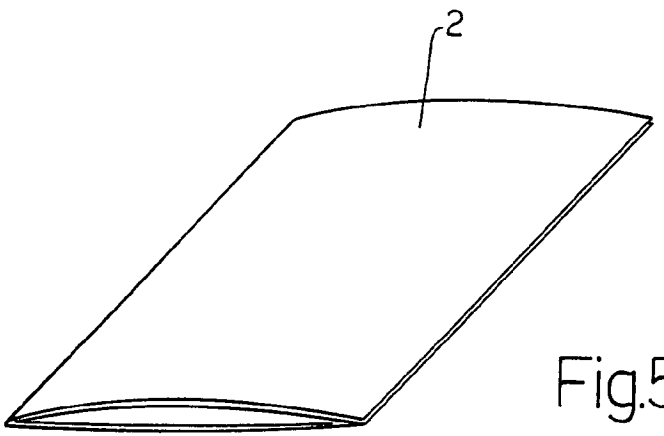
FIG. 5 shows a view in perspective of a folded coupon.

Number 1 in FIG. 1 indicates as a whole a unit for folding coupons 2 (FIGS. 4 and 5) on a packing machine (not shown). More specifically, each coupon is in the form of an elongated rectangle, and folding unit 1 folds coupon 2 along three fold lines 3 to form a folded coupon 2 of rectangular, almost square, shape.

Figure 3:
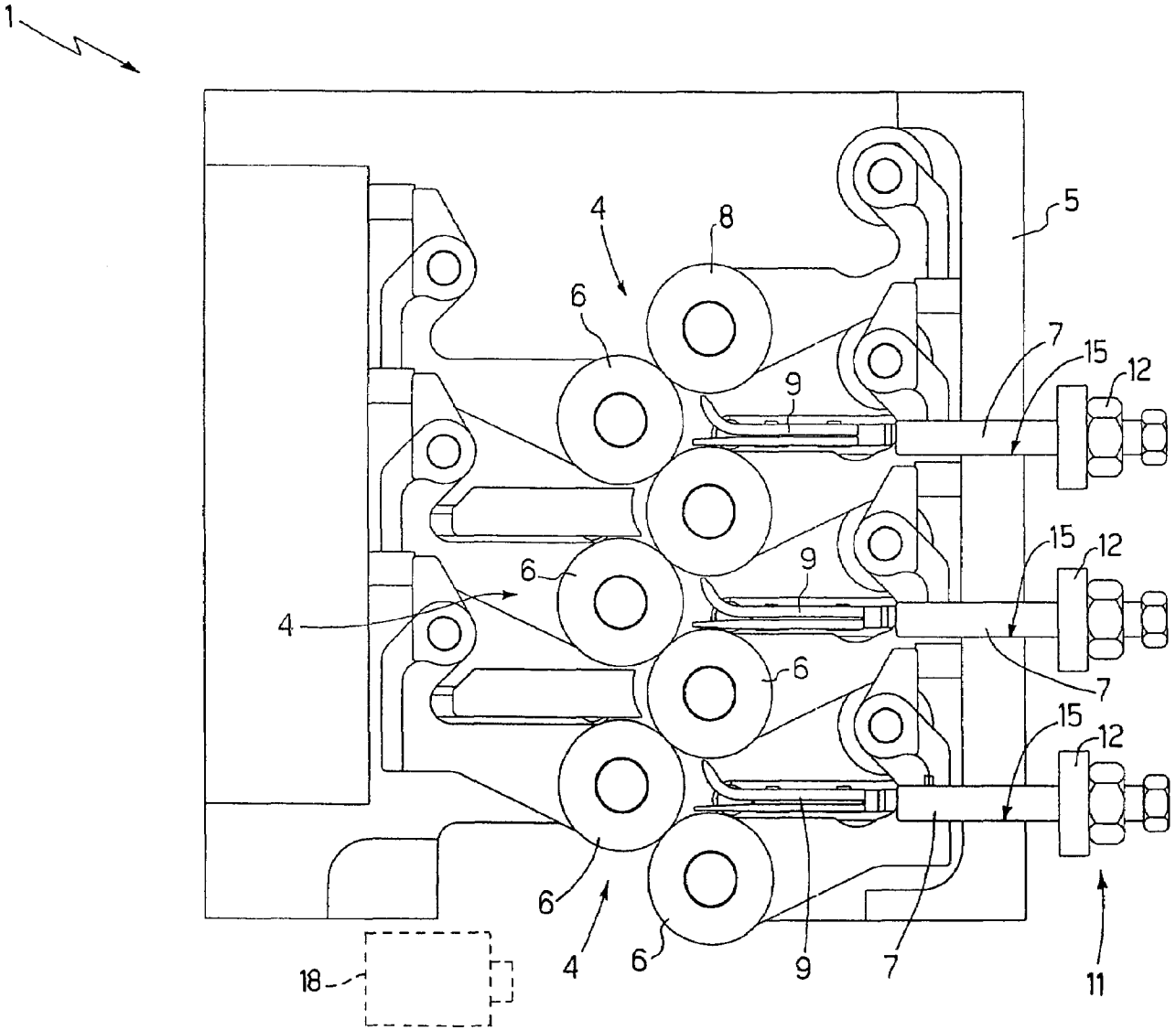
FIG. 3 shows a front view, with parts removed for clarity, of the coupon-folding unit in FIG. 1.

As shown in FIG. 3, folding unit 1 comprises three folding stations 4 fitted to a box frame 5 and arranged in series to successively fold each coupon 2 about the three fold lines 3. The number and arrangement of folding stations 4 may obviously vary to fold each coupon otherwise than as shown by way of example in FIGS. 4 and 5.

Each folding station 4 comprises two counter-rotating folding rollers 6; and two locating members 7 located side by side at one end of a feed path of coupons 2 extending over the two folding rollers 6. The folding station 4 at the input of folding unit 1 is fitted with a lead-in roller 8 which cooperates with a respective folding roller 6; and a lead-in member 9 is provided at each pair of locating members 7, has a funnel-shaped inlet, and provides for feeding coupons 2 correctly to locating members 7.

Figure 2:
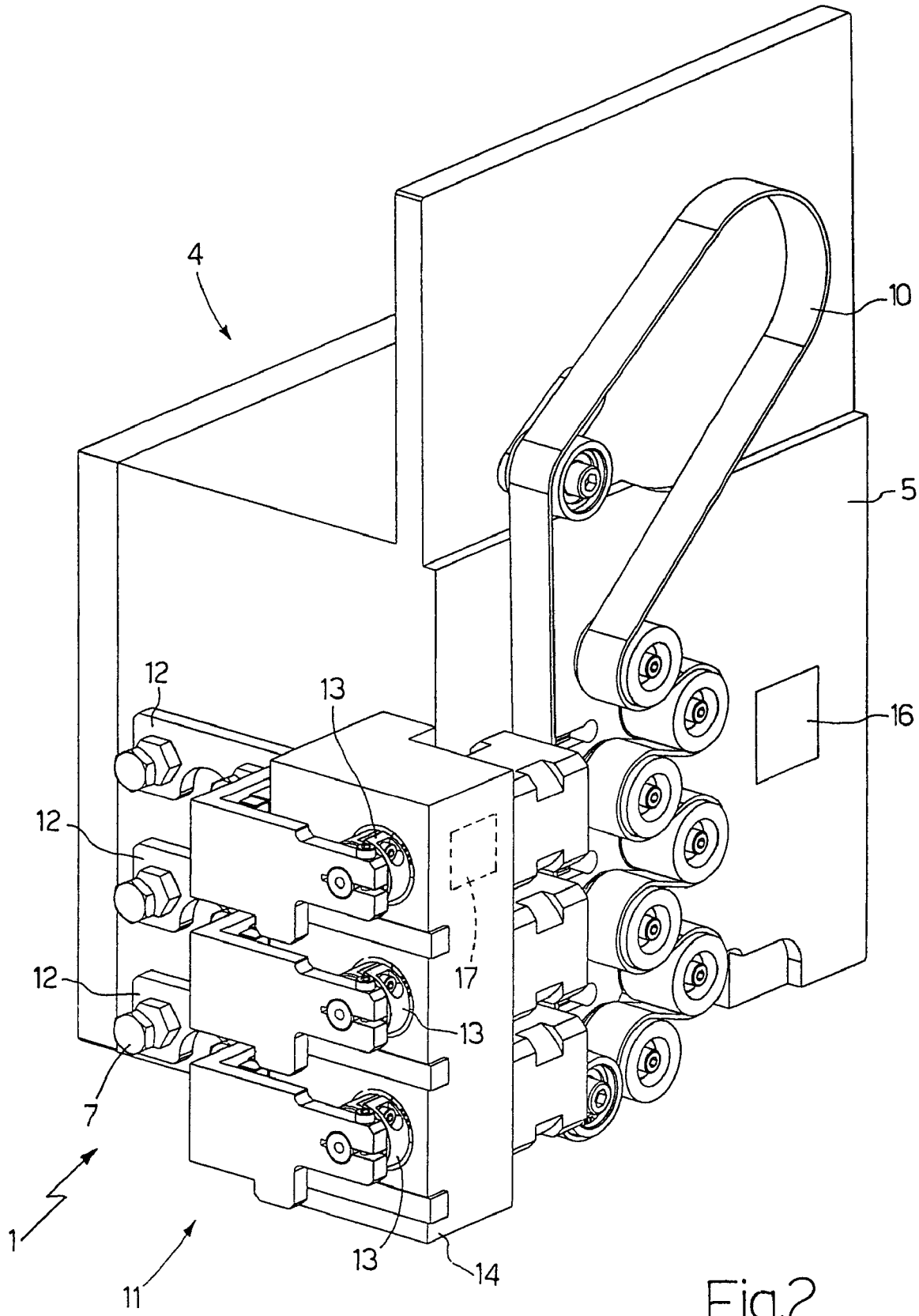
FIG. 2 shows a further view in perspective of the coupon-folding unit in FIG. 1.

As shown in FIG. 2, folding rollers 6 and lead-in roller 8 are rotated at the same angular speed and in alternating rotation directions by one belt 10 powered by an electric motor (not shown).

In actual use, a flat coupon 2 is fed by a known conveyor (not shown) to the input of folding unit 1, so that it is engaged between lead-in roller 8 and the corresponding folding roller 6; and the drawing action of lead-in roller 8 and corresponding folding roller 6 feeds the flat coupon 2 over the two folding rollers 6 at the first folding station 4 until one end of coupon 2 comes to rest against locating members 7 at the first folding station 4. At this point, an intermediate portion of coupon 2 is gradually engaged by folding rollers 6 at the first folding station 4, so that coupon 2 is fed between the folding rollers 6, is folded about a fold line 3, and is then fed over the two folding rollers at the second folding station 4. The folding process is repeated, as described above, at the second and third folding station 4 to complete the folding of coupon 2.

The position of each fold line 3 along coupon 2 is therefore determined by the position of the corresponding locating members 7 with respect to the corresponding pair of folding rollers 6, i.e. by the position of corresponding locating members 7 along the feed path of coupons 2.

Folding unit 1 also comprises an adjusting device 11 by which to adjust the position of each pair of locating members 7 along the feed path of coupons 2 during normal operation of folding unit 1. As shown in FIGS. 1 and 2, for each pair of locating members 7, adjusting device 11 comprises a double-L-shaped supporting member 12 connected rigidly at one end to locating members 7, and connected rigidly at the opposite end to the movable part of a linear electric motor 13 fixed to frame 5 of folding unit 1. More specifically, adjusting device 11 comprises a substantially parallelepiped-shaped supporting body 14 bolted to frame 5 of folding unit 1 and having three seats (not shown in detail) housing the three linear electric motors 13.

As shown in FIG. 3, each locating member 7 is elongated and cylindrical in shape, and has a first end connected rigidly to supporting member 12, and a second end, opposite the first end, inserted in sliding manner inside a respective hole 15 in frame 5 of folding unit 1.

Adjusting device 11 therefore provides for adjusting the position of each pair of locating members 7 independently of the positions of the other pairs of locating members 7. In an alternative embodiment not shown, adjusting device 11 comprises a single linear electric motor 13, and so provides for adjusting the positions of all the pairs of locating members 7 together.

Adjusting device 11 is connected to a sensor device 16 for cyclically determining the operating speed of folding unit 1 (i.e. the operating speed of folding stations 4), and so provides for adjusting the position of each pair of locating members 7 along the feed path of coupons 2 as a function of the operating speed of folding unit 1. In a preferred embodiment, adjusting device 11 comprises a memory 17 storing an adjustment table, which, for each operating speed value of folding unit 1, supplies adjusting device 11 with a corresponding position value of each pair of locating members 7.

In a further embodiment, adjusting device 11 comprises a detecting device 18 located downstream from folding stations 4 and for determining the position of at least one fold line 3 of each coupon 2, so that adjusting device 11 adjusts the position of each pair of locating members 7 along the feed path of coupons 2 as a function of the position of at least one fold line 3. Detecting device 18 is preferably optical, and determines the position of fold lines 3 indirectly by analyzing folded coupon 2. More specifically, detecting device 18 determines the position of fold lines 3 as a function of the size of folded coupon 2 and/or the degree of overlap of the free portions of folded coupon 2.

In various alternative embodiments, adjusting device 11 adjusts the position of each pair of locating members 7 as a function of the operating speed of folding unit 1, or as a function of the position of fold lines 3, or as a function of both the operating speed of folding unit 1 and the position of fold lines 3.

Preferably, upstream from folding unit 1, an unwinding device (not shown) is provided to unwind a flat strip (not shown) off a reel (not shown), and a cutting station (not shown) is provided to cut the flat strip, along a cutting line crosswise to the travelling direction of the strip, into successive coupons 2, which are then fed to folding unit 1. Downstream from folding unit 1, at least one gripping head (not shown) is provided to feed each folded coupon 2 into a seat on a packing conveyor (not shown) and onto packing material (not shown) inside the seat. A first motor (not shown) is provided to unwind the flat strip continuously at substantially constant speed off the reel, and a second motor (not shown) is provided to feed the strip in steps to the cutting station. A compensating device (not shown) is interposed between the first and second motor to form a loop of varying length in the strip upstream from the cutting station, so that the speed of the strip is zeroed cyclically at the cutting station to enable the strip to be fed to the cutting station in steps.

Folding unit 1 as described above has numerous advantages: it is compact, is cheap and easy to produce, can operate at high speed, and provides for good-quality folds within a wide range of operating speeds (practically from zero to nominal speed). In other words, folding unit 1 as described operates well at all possible operating speeds, which can therefore be safely changed continually.

In view of its numerous advantages, folding unit 1 as described may also be used to advantage on other automatic machines for packing products other than cigarettes, or on automatic machines for other than product packing purposes.

The invention claimed is:

1. A method of folding coupons on a packing machine; the method comprising the steps of:

providing at least one folding station (4) comprising two counter-rotating folding rollers (6) and at least one locating member (7) located at one end of a feed path of the coupons (2) extending over the two folding rollers (6)

feeding the coupons (2) to the folding station (4)

determining cyclically the operating speed of the folding station (4); and adjusting the position of the locating member (7) along the feed path of the coupons (2) during normal operation of the folding station (4) and as a function of the operating speed of the folding station (4) so that the position of the locating member (7) is adjusted when the operating speed of the folding station (4) changes.

2. A method as claimed in claim 1, wherein an adjustment table is determined, and, for each operating speed value of the folding station (4), supplies a corresponding position value of the locating member (7) along the feed path of the coupons (2).

3. A method as claimed in claim 1, wherein the folding station (4) folds each coupon (2) along a given fold line (3); for each coupon (2) and downstream from the folding station (4), the position of the fold line (3) being determined, and the position of the locating member (7) along the feed path of the coupons (2) being adjusted as a function of the position of the fold line (3).

4. A method as claimed in claim 3, wherein the position of the fold line (3) is determined indirectly by analyzing the folded coupon (2).

5. A method as claimed in claim 4, wherein the folded coupon (2) is analyzed optically.

6. A method as claimed in claim 4, wherein the position of the fold line (3) is determined indirectly as a function of the size of the folded coupon (2).

7. A method as claimed in claim 4, wherein the position of the fold line (3) is determined indirectly as a function of the degree of overlap of the free portions of the folded coupon (2).

8. A method as claimed in claim 1, wherein the coupons (2) are fed to a number of successive folding stations, each of which comprises two counter-rotating folding rollers (6), and a locating member (7) located at one end of a feed path of the coupons (2) extending over the two folding rollers (6); the position of each locating member (7) along the respective feed path of the coupons (2) being adjusted during normal operation of the folding stations.

9. A method as claimed in claim 8, wherein the position of each locating member (7) along the respective feed path of the coupons (2) is adjusted independently of the positions of the other locating members (7).

10. A method as claimed in claim 8, wherein the positions of all the locating members (7) are adjusted together.

11. A method as claimed in claim 1, and comprising the steps of:

unwinding a flat strip off a reel; feeding the flat strip to a cutting station where the flat strip is cut along a cutting line crosswise to the travelling direction of the strip to cut the coupons (2) successively off the strip;

feeding the coupons (2) to the folding station (4); and engaging each folded coupon (2) by means of a gripping head to feed the folded coupon (2) to a seat on a packing conveyor and onto packing material inside the seat.

12. A method as claimed in claim 11, wherein the flat strip is unwound off the reel continuously at substantially constant speed, and is fed in steps to the cutting station; a loop being formed in the strip upstream from the cutting station, and the length of the loop being varied constantly to cyclically zero the speed of the strip at the cutting station and so permit step-feed of the strip to the cutting station.

13. A unit for folding coupons on a packing machine; the unit (1) comprising a folding station (4) in turn comprising two counter-rotating folding rollers (6), and at least one locating member (7) located at one end of a feed path of the coupons (2) extending over the two folding rollers (6);

sensor means for cyclically determining the operating speed of folding station (4); and adjusting means (11) for adjusting the position of the locating member (7) along the feed path of the coupons (2) during normal operation of the folding station (4) and as a function of the operating speed of the folding station (4) so that the position of the locating member (7) is adjusted when the operating speed of the folding station (4) changes.

14. A unit as claimed in claim 13, wherein a memory is provided to store an adjustment table, which, for each operating speed value of the folding station (4), supplies the adjusting means (11) with a corresponding position value of the locating member (7) along the feed path of the coupons (2).

15. A unit as claimed in claim 13, wherein the folding station (4) folds each coupon (2) along a given fold line (3); detecting means being provided downstream from the folding station (4) to determine the position of the fold line (3) of each coupon (2), and which are connected to the adjusting means (11); and the adjusting means (11) adjusting the position of the locating member (7) along the feed path of the coupons (2) as a function of the position of the fold line (3).

16. A unit as claimed in claim 15, wherein the detecting means determine the position of the fold line (3) indirectly by analyzing the folded coupon (2).

17. A unit as claimed in claim 16, wherein the detecting means are optical.

18. A unit as claimed in claim 16, wherein the detecting means determine the position of the fold line (3) as a function of the size of the folded coupon (2).

19. A unit as claimed in claim 16, wherein the detecting means determine the position of the fold line (3) indirectly as a function of the degree of overlap of the free portions of the folded coupon (2).

20. A unit as claimed in claim 13, wherein a number of successive folding stations are provided, each of which comprises two counter-rotating folding rollers (6), and a locating member (7) located at one end of a feed path of the coupons (2) extending over the two folding rollers (6); the adjusting means (11) adjusting the position of each locating member (7) along the respective feed path of the coupons (2) during normal operation of the folding stations.

21. A unit as claimed in claim 20, wherein the adjusting means (11) adjust the position of each locating member (7) along the respective feed path of the coupons (2) independently of the positions of the other locating members (7).

22. A unit as claimed in claim 20, wherein the adjusting means (11) adjust the positions of all the locating members (7) together.

23. A unit as claimed in claim 13, and comprising: an unwinding device for unwinding a flat strip off a reel; a cutting station located upstream from the folding station (4) and where the flat strip is cut along a cutting line crosswise to the travelling direction of the strip to cut the coupons (2) successively off the strip; at least one gripping head located downstream from the folding station (4) and which feeds the folded coupon (2) to a seat on a packing conveyor and onto packing material inside the seat.

24. A unit as claimed in claim 23, wherein first drive means are provided to unwind the flat strip off the reel continuously at substantially constant speed, and second drive means are provided to feed the strip in steps to the cutting station; a compensating device being interposed between the first and second drive means to form a loop of varying length in the strip upstream from the cutting station, so as to cyclically zero the speed of the strip at the cutting station and so permit step-feed of the strip to the cutting station.

25. A unit as claimed in claim 13, wherein the adjusting means (11) comprise a supporting member connected rigidly at one end to the locating member (7) and connected rigidly at the opposite end to the movable part of a linear motor fixed to a frame (5) of the unit (1).

26. A unit as claimed in claim 25, wherein the supporting member is double-L-shaped.

27. A unit as claimed in claim 25, wherein the locating member (7) is elongated in shape, and has a first end rigidly connected to the supporting member, and a second end, opposite the first end, inserted in sliding manner inside a respective whole in the frame (5) of the unit (1).

* * * * *

UNITED STATES PATENT AND TRADEMARK OFFICE

CERTIFICATE OF CORRECTION

PATENT NO. : 7,303,520 B2
APPLICATION NO. : 11/158224
DATED : December 4, 2007
INVENTOR(S) : Andrea Biondi It is certified that error appears in the above-identified patent and that said Letters Patent is hereby corrected as shown below:

On title page, item 30, "B2004A0405" should be -- BO2004A000405 --.

Signed and Sealed this

Second Day of September, 2008

JON W. DUDAS
*Director of the United States Patent and Trademark Office*